US005272886A

United States Patent [19]

Ukai et al.

[11] Patent Number: 5,272,886

[45] Date of Patent: Dec. 28, 1993

[54] MOISTURE DISPOSING DEVICE FOR USE IN A SELF-CONTAINED AIR CONDITIONER

[75] Inventors: Koichi Ukai; Hideki Matsumi, both of Shiga, Japan

[73] Assignee: Matsushita Electric Industrial Co., Ltd., Osaka, Japan

[21] Appl. No.: 866,959

[22] Filed: Apr. 9, 1992

Related U.S. Application Data

[63] Continuation of Ser. No. 641,950, Jan. 16, 1991, abandoned.

[30] Foreign Application Priority Data

Jan. 19, 1990 [JP] Japan ..... 2-11377

[51] Int. Cl.[5] ..... F25B 47/00

[52] U.S. Cl. ..... 62/280; 62/262; 165/122

[58] Field of Search ..... 62/262, 280, 263, 272, 62/279; 165/122

[56] References Cited

U.S. PATENT DOCUMENTS

| | | | |
|---|---|---|---|
| 2,355,619 | 8/1944 | Bossart | 165/122 |
| 2,945,359 | 7/1960 | MacLeod | 62/280 |
| 2,984,089 | 5/1961 | Whitesel | 62/280 |
| 3,872,684 | 3/1975 | Scott | 62/280 |
| 5,081,849 | 1/1992 | Thompson et al. | 62/262 |

FOREIGN PATENT DOCUMENTS

| | | | |
|---|---|---|---|
| 0110169 | 4/1940 | Australia | 22/280 |

*Primary Examiner*—John M. Sollecito

*Attorney, Agent, or Firm*—Panitch Schwarze Jacobs & Nadel

[57] ABSTRACT

A moisture disposing device for use in a self-contained air conditioner, wherein the device includes a casing including a base plate on which components are mounted, a heat exchanger, a propeller fan located in opposition to the heat exchanger, an air guider connected to the heat exchanger, the air guider and the propeller fan constituting an air passageway, a slinger ring fitted to the propeller fan, the air guider having an orifice whose shape is vertically oblong, and having a larger radius of the major axis at each oblong end than half of the diameter of the slinger ring.

6 Claims, 4 Drawing Sheets

MOISTURE DISPOSING DEVICE FOR USE IN A SELF-CONTAINED AIR CONDITIONER

This application is a continuation of application Ser. No. 641,950, filed Jan. 16, 1991, now abandoned.

BACKGROUND OF THE INVENTION

1. Field of the Invention

The present invention relates generally to a self-contained air conditioner, and more particularly to a moisture disposing device for use in a self-contained air conditioner, the device having a propeller fan equipped with a slinger ring toward the outside.

2. Description of the Prior Art

An air conditioner unavoidably produces moisture, and it is a vexing problem how to dispose of this moisture. A typical moisture disposing device is known in the art, which will be described by reference to FIG. 6. This known device includes an air guider 20 having a circular orifice 21 whose diameter is larger than the outside diameter of a propeller fan 22 but smaller than the outside diameter of a slinger ring 23. The propeller fan 22 is coaxial with the orifice 20. A flange 24, having the same diameter as that of the orifice 21, is provided downstream around it. In this specification "downstream" and "upstream" means the flowing direction of air after and before the propeller fan, respectively. The flange 24 allows a shield 25 to be welded thereto. The shield 25 is to prevent splashed water from dispersing. and has a bent portion 26 projecting toward the center of the orifice 21, the bent portion 26 being designed to prevent water from flowing into the body of the air conditioner.

This known moisture disposing device disadvantageously requires complicated procedures for assembly and disassembly. This derives from the following factors; that is, (1) the orifice 21 is circular, (2) the diameter of the orifice is smaller than that of the slinger ring 23, (3) the slinger ring 23 is located between a heat exchanger 28 upstream and the air guider 20. These factors require that when the propeller fan 22 is removed for replacement, repair or cleaning, the heat exchanger must be first dismounted. In addition, each component is fixed to a base plate 29, and all of them are accommodated in a casing 30. Thus, when the moisture disposing device is disassembled or assembled, many steps must be taken, and the components are numerous, thereby increasing the production cost. In addition, because of the axial alignment of the propeller fan 22 and the orifice 21, the propeller fan 22 must be inserted into the orifice 21, only in a horizontal direction from the side of the heat exchanger 28. To achieve this insertion, the air guider 20 must be provided such that a rear flange 34 of the base plate 29 is as high as not to hinder the propeller fan 22 from being inserted. This requires a relatively long air conditioner so as to have a sufficient space for allowing smooth insertion. The shield 25, designed to prevent moisture from scattering around, increases resistance to the air flowing from the intake to the outlet, thereby decreasing the rate of air and making noises.

Since a pressure in the downstream section between the air guider 20 and the heat exchanger 28 is higher than the one in the upstream section, moisture tends to be burst through a lower part of the orifice 21, and is scooped up by the propeller fan 22. Thus, the bent portion 26 becomes ineffective in preventing moisture from splashing.

SUMMARY OF THE INVENTION

The moisture disposing device of this invention, which overcomes the above-discussed and numerous other disadvantages and deficiencies of the prior art, comprises a casing including a base plate on which components are mounted, a heat exchanger, a propeller fan located in opposition to the heat exchanger, an air guider connected to the heat exchanger, the air guider and the propeller fan constituting an air passageway, a slinger ring fitted to the propeller fan, the air guider having an orifice whose shape is vertically oblong, and having a larger radius of the major axis at each oblong end than half of the diameter of the slinger ring.

In a further embodiment, the center of the propeller fan is located below the center of the major axis of the orifice.

In a preferred embodiment, a flange is additionally provided along the orifice, wherein the flange is extended downstream and has an outwardly bent portion.

In a preferred embodiment, a flange is additionally provided along the orifice, wherein the flange has an inwardly bent portion.

Thus, the invention described herein makes possible the objectives of (1) providing a moisture disposing device which is easily assembled and disassembled with a minimum number of steps and a minimum number of components, (2) providing a moisture disposing device of a reduced size, and (3) providing a moisture disposing device easily incorporated in an air conditioner so as to constitute a self-contained unity.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENTS

Figure 1:
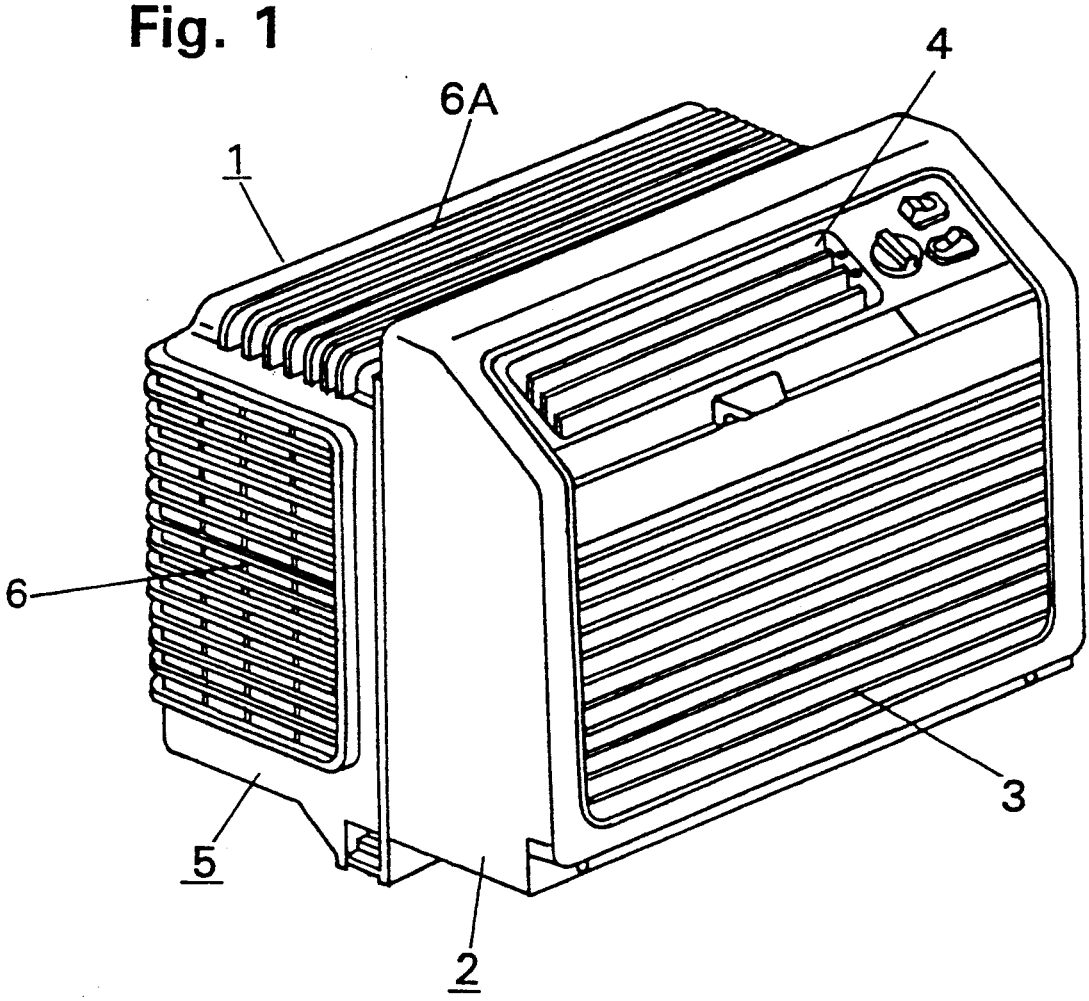
FIG. 1 is a perspective view showing a self-contained air conditioner facing a room, including a moisture disposing device according to the present invention.
Figure 2:
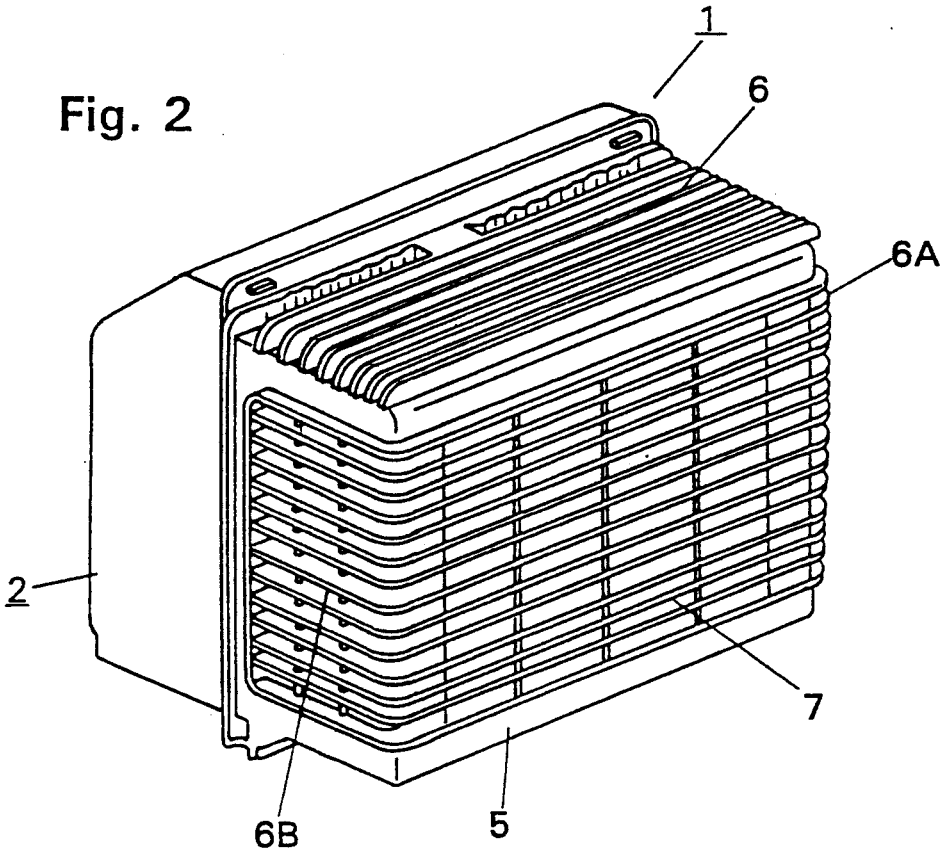
FIG. 2 is a perspective view showing a self-contained air conditioner facing outside.

Referring to FIGS. 1 and 2, a first example of the present invention will be described;

The illustrated air conditioner 1 includes a known refrigerating cycle, an air intake panel 2 having louvers 3 toward a room, a first fan 18 for sucking air from the room, a heat exchanger 19 for cooling the air, and louvers 4 for allowing cooled air to be directed to any part of a room, and a casing 5 includes a pan portion for collecting moisture from the heat exchanger 19 and a frame portion 5A including a supporting portion 5B. In addition, the air conditioner 1 houses intake grille 6 on top, 6A and 6B on each side toward the outdoor. The intake grilles 6, 6A, and 6B allow air in from outside, and the air is sent through an air guider 8 to a second heat exchanger 11. The air passing through the second heat exchanger 11 is discharged outside. The water stored in the casing 5 is scooped by the slinger ring 10 fitted to a propeller fan 9, and sprinkled over the second heat exchanger 11 so as to vaporize it. The casing 5 is box-shaped and includes an opening for partitioning the casing 5 into an inner chamber and an outer chamber, and provided with a bulkhead 12 over the opening. A motor 13 has a rotary shaft connected to the propeller fan 9, whereby the propeller fan 9 is driven. The second heat exchanger 11 and the air guider 8 are respectively inserted onto the casing 5 through the opening toward the outside, and are both fixed to the casing 5 by means of the same screws. The propeller fan 9 is fixed to the bulkhead 12 through the motor 13, and inserted into the air guider 8 through the opening toward the room and the bulkhead 12 is detachably fixed to the frame portion 5A of the casing 5 by means of the supporting portion 5B. In order to achieve the fixture of the bulkhead 12 to the frame portion 5A, the orifice 14 of the air guider 8 is vertically elongated with a larger radius than that of the slinger ring 10. In this way every component is fixed to the frame portion 5A of the casing 5, thereby reducing the number of steps to be taken in assembling and disassembling the air conditioner.

Figure 3:
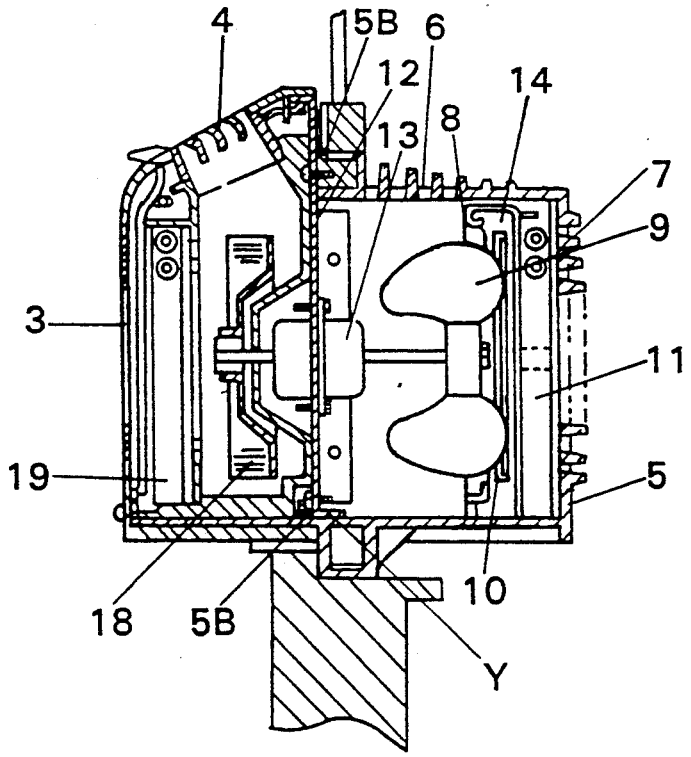
FIG. 3 is a cross-sectional view showing a modified version of the air conditioner.

Referring to FIG. 3, a modification will be described: This modification is characterized in that because of the increased weight of the bulkhead 12 due to the motor 13 and propeller fan 9 fixed thereto, it is placed on the frame portion 5A of the casing 5 in a diagonal direction, and rotated about a lowest part Y thereof so as to enable the propeller fan 9 to position in an orifice 14 of the air guider 8. It is arranged so that the center of the propeller fan 9 is slightly lower than the center of the vertically oblong orifice 14 so as to avoid any collision between an upper part of the orifice 14 and the slinger ring 10. In this way the propeller fan 9 can be easily inserted into the orifice 14 from the side of the room, and the assemblage of the propeller fan 9 can be carried out with no interference of components, thereby minimizing the size of the air conditioner.

Figure 4:
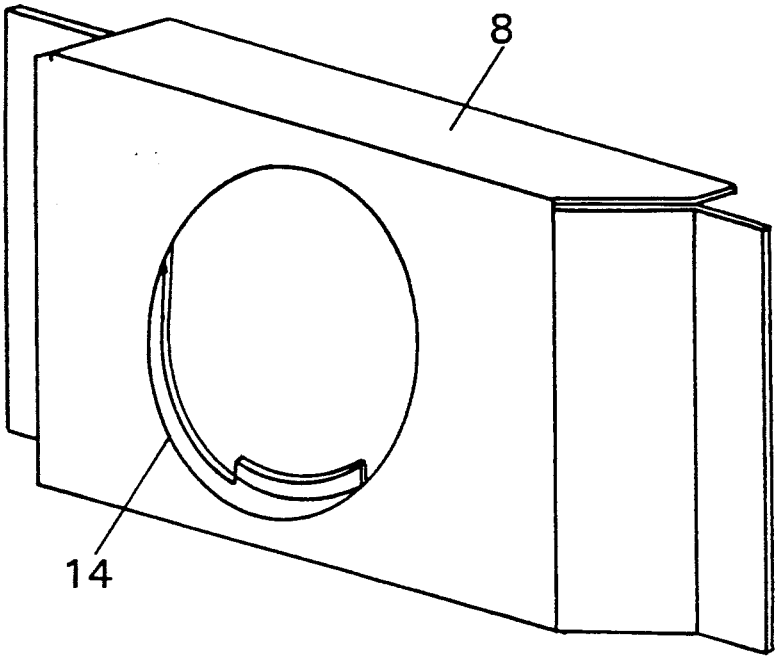
FIG. 4 is a perspective view showing a modified version of the air guider shown in FIG. 1.
Figure 5:
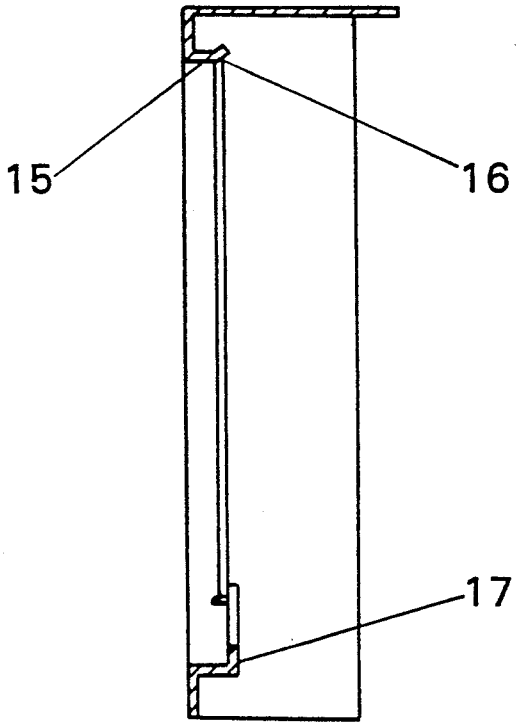
FIG. 5 is a vertical cross-sectional view showing a main portion of the air guider shown in FIG. 4.
Figure 6:
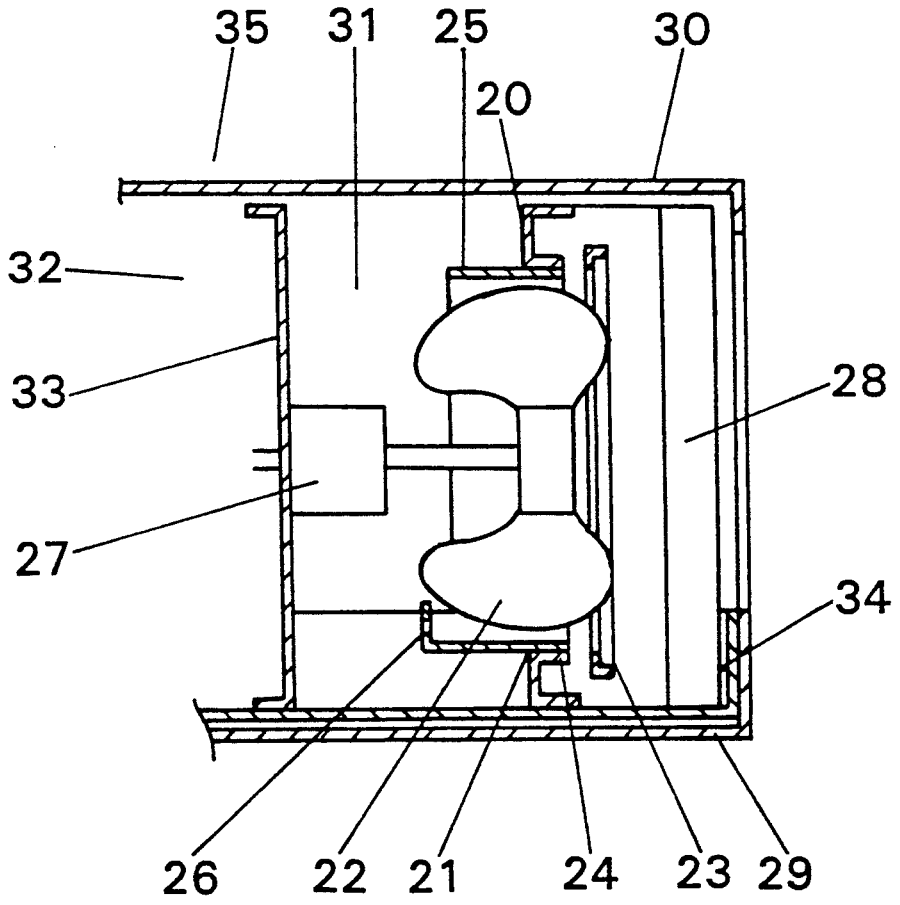
Fig. 6 PRIOR ART
FIG. 6 is a cross-sectional view showing a known air conditioner.

FIGS. 4 and 5 show a further modified example which has a flange 15 having the same elongated circular shape as that of the orifice 14, slightly extended downstream, and having an outwardly bent edge 16 designed to drain water. Under this arrangement moisture scooped by the slinger ring 10 is sprayed toward the ceiling and side walls of the air guider 8, and is likely to be dispersed in air. To prevent such dispersion of water, the bent edge 16 leads the moisture downward so as to prevent it from dispersing.

In FIG. 5, a flange 15 is provided with a hooked portion 17 which prevents the moisture from overflowing.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A moisture disposing device for use in a self-contained air conditioner, the device comprising;

a casing including an opening and a frame portion including means for supporting a bulkhead detachably secured over the opening;

an electric motor secured to the bulkhead for a propeller fan;

a heat exchanger attached to the frame portion and located downstream of the bulkhead;

a propeller fan attached to a shaft of the electric motor and located upstream of the heat exchanger and downstream of the bulkhead;

an air guider within the casing connected to at least one of the heat exchanger and the frame portion, the air guider and the propeller fan constituting an air passageway;

a slinger ring fitted to the propeller fan for scooping water in the casing and sprinkling the scooped water over the propeller fan; and the air guider having an orifice whose shape is vertically oblong, the orifice having a radius of the major axis at each oblong end which is greater than half of the diameter of the slinger ring.

2. A moisture disposing device as defined in claim 1, wherein the center of the propeller fan is located below the center of the major axis of the orifice.

3. A moisture disposing device as defined in claim 1, further comprising a flange provided along the orifice, wherein the flange is extended downstream and has an outwardly bent portion.

4. A moisture disposing device as defined in claim 1, further comprising a flange provided along the orifice, wherein the flange has an inwardly bent portion.

5. A moisture disposing device for use in a self-contained air conditioner, said device comprising:

a casing having an opening and a frame portion including means for supporting a detachable bulkhead over said opening;

a heat exchanger attached to said frame portion and located downstream of said bulkhead;

an electric motor secured to said bulkhead, said motor including a shaft;

a propeller fan attached to the shaft of said motor, said propeller fan being located between said heat exchanger and said bulkhead;

an air guider within said casing connected to at least one of said heat exchanger and said frame portion, said air guider defining an interior area constituting an air passageway within which said propeller fan is disposed, said air guider having a vertically oblong-shaped orifice; and a slinger ring fitted to said propeller fan for scooping water in said casing and sprinkling the scooped water over the propeller fan, said orifice of said air guider having a radius of the major axis at each oblong end which is greater than half of the diameter of said slinger ring.

6. The moisture disposing device of claim 5, wherein said orifice has a radius in the horizontal direction which is smaller than half of the diameter of said slinger ring.

* * * * *